US012612829B1

(12) United States Patent
Jawad et al.

(10) Patent No.: US 12,612,829 B1
(45) Date of Patent: Apr. 28, 2026

(54) DECENTRALIZER TOOL FOR USE WITH WIRELINE LOGGING OPERATIONS

(71) Applicant: KING FAHD UNIVERSITY OF PETROLEUM AND MINERALS, Dhahran (SA)

(72) Inventors: Ali Dheyaa Jawad, Baghdad (IQ); Ahmed Zarzor Hussien Yaseri, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 19/369,140

(22) Filed: Oct. 24, 2025

Related U.S. Application Data

(60) Provisional application No. 63/769,350, filed on Mar. 10, 2025.

(51) Int. Cl.
*E21B 23/01* (2006.01)
*E21B 17/10* (2006.01)
*E21B 47/01* (2012.01)

(52) U.S. Cl.
CPC ..... *E21B 17/1028* (2013.01)

(58) Field of Classification Search
CPC ..... E21B 17/1028; E21B 17/1014; E21B 17/1021; E21B 47/08; E21B 47/01; E21B 23/00; E21B 23/01; E21B 47/017; E21B 49/00; G01V 11/005
See application file for complete search history.

(56) References Cited

U.S. PATENT DOCUMENTS 3,058,227 A * 10/1962 Camp ..... E21B 47/08 33/544.3
4,120,353 A * 10/1978 Roesner ..... E21B 47/08 166/66.4
RE32,070 E * 1/1986 Vezin ..... E21B 47/08 324/374
8,235,109 B2 8/2012 Vaeth et al.
(Continued)

FOREIGN PATENT DOCUMENTS

CN 1670331 A 9/2005

OTHER PUBLICATIONS

Mechanical Centralizers and Decentralizers, Hunting Plc, 2014, 1 Page.

*Primary Examiner* — Kipp C Wallace
(74) *Attorney, Agent, or Firm* — Oblon, McClelland, Maier & Neustadt, L.L.P.

(57) ABSTRACT

A decentralizer tool and a method of operating the decentralizer tool include a housing sized to enter a wellbore. An adapter is coupled to an end of the housing to connect the decentralizer tool to a bulk density tool. A spring partially defines an outer diameter of the decentralizer tool. The spring includes a first spring end, a second spring end, and an intermediate spring section. A spring support member includes an exposed portion and a hidden portion internal to the housing. A motor is internal to the housing and an actuator is interposed between the spring support member and the motor. The actuator moves the spring support member in an axial direction along a tool axis between a first target position and a second target position of the spring support member to change a state of the spring.

19 Claims, 13 Drawing Sheets

(56) References Cited

U.S. PATENT DOCUMENTS

| | | | | |
|---|---|---|---|---|
| 11,078,740 | B2 * | 8/2021 | Bonavides | E21B 17/1028 |
| 2003/0024710 | A1 * | 2/2003 | Post | E21B 23/0411<br>166/66.4 |
| 2007/0029197 | A1 * | 2/2007 | DiFoggio | G01V 11/005<br>204/450 |
| 2010/0084144 | A1 * | 4/2010 | Vaeth | E21B 17/1028<br>166/383 |
| 2018/0298745 | A1 * | 10/2018 | Toniolo | E21B 47/01 |
| 2019/0063214 | A1 * | 2/2019 | Castillo | E21B 17/1057 |

* cited by examiner

| Test Number | Spring Force (N) | Motor Control Precision (%) | Measurement Accuracy (%) |
|---|---|---|---|
| 1.0 | 120.0 | 98.5 | 95.2 |
| 2.0 | 150.0 | 99.2 | 96.0 |
| 3.0 | 135.0 | 97.8 | 94.8 |
| 4.0 | 160.0 | 99.0 | 96.5 |
| 5.0 | 140.0 | 98.7 | 95.9 |

FIG. 13

DECENTRALIZER TOOL FOR USE WITH WIRELINE LOGGING OPERATIONS

CROSS-REFERENCE TO RELATED APPLICATION

The present application claims benefit of priority to U.S. Provisional Patent Application No. 63/769,350 having a filing date of Mar. 10, 2025 which is incorporated herein by reference in its entirety.

BACKGROUND

Technical Field

The present disclosure is directed to a well logging instrument and more particularly relates to a decentralizer tool for use with wireline logging operations.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Oil and gas industry heavily relies on drilling tools to access reserves located beneath the surface of the Earth. A wellbore is constructed to extract these reserves through systematic drilling operations. The construction of the wellbore requires precision and reliability to overcome numerous obstacles encountered during drilling operations, including varying geological formations, extreme downhole conditions, and complex wellbore geometries. Wellbore operations require specialized tools to navigate these challenging subsurface environments effectively.

Tools such as a decentralizer play a significant role in wireline logging operations. A decentralizer is a specialized tool designed to work in conjunction with bulk density tools during wireline logging operations, ensuring proper standoff distance between the decentralizer tool and wellbore for accurate formation evaluation.

However, conventional decentralizers present several limitations and challenges during operation. These tools suffer from inconsistent tool-to-formation contact, resulting in inaccurate bulk density measurements and data quality. Further, conventional decentralizer designs exhibit a tendency towards tool sticking during descent operations, particularly when navigating complex wellbore geometries or encountering wellbore restrictions. This mechanical failure not only disrupts logging operations and delays but also poses substantial financial risks through potential equipment loss and the need for operations to retrieve stuck tools.

Other known decentralizer tools suffer from one or more drawbacks hindering their adoption, including inadequate mechanical flexibility, complex deployment procedures that increase operational time and labor costs, and unreliable contact mechanisms that compromise measurement accuracy. Accordingly, it is one object of the present disclosure to provide a decentralizer tool that overcomes these technical limitations and challenges present in conventional decentralizer tools.

SUMMARY

In an exemplary embodiment, a decentralizer tool for use with wireline logging operations is disclosed. The decentralizer tool includes a housing sized to enter a wellbore and defining a tool axis of the decentralizer tool. The decentralizer tool further includes an adapter at an end of the housing configured to connect to a bulk density tool. A spring partially defines an outer diameter of the decentralizer tool. The spring includes a first spring end coupled to an exterior tool surface of the housing, a second spring end external to the housing that is spaced apart from the first spring end, and an intermediate spring section between the first and second spring ends. A spring support member includes an exposed portion coupled to the second spring end and a hidden portion internal to the housing. A motor is internal to the housing and an actuator is operatively interposed between the spring support member and the motor. The actuator is configured to move, via motor output, the spring support member in an axial direction along the tool axis between a first target position and second target position of the spring support member to change a state of the spring. Further, movement of the spring support member towards the first spring end causes the intermediate spring section to expand toward an inner wall structure of the wellbore to engage the inner wall structure, and movement of the spring support member away from the first spring end causes the intermediate spring section to contract away from the inner wall structure to disengage from the inner wall structure.

In some embodiments, the spring includes a bow spring.

In some embodiments, the housing includes a circumferential wall defining a tool bore in which the motor or the actuator is centrally disposed.

In some embodiments, the housing further includes a motor support bracket coupling the motor to an inner surface of the circumferential wall such that a motor output portion of the motor is concentric with the circumferential wall.

In some embodiments, the actuator includes a rotatable component connected to the motor output portion of the motor that extends linearly away from the motor output portion toward the adapter such that the rotatable component is concentric with the circumferential wall.

In some embodiments, an actuator support member protrudes from the inner surface of the circumferential wall in a radially inward direction toward the tool axis that is configured to rotatably support an end of the rotatable component of the actuator.

In some embodiments, the housing includes an opening thereon exposing an enclosed cavity defined by the housing. The spring support member passes through the opening from the second spring end to an actuable component of the actuator.

In some embodiments, the opening on the housing includes an elongated slot arranged parallel to the tool axis.

In some embodiments, the hidden portion of the spring support member includes a proximal end of the spring support member disposed in the enclosed cavity that is connected to the actuable component, and wherein the exposed portion of the spring support member includes a distal end of the spring support member external to the enclosed cavity.

In some embodiments, the spring support member is tapered such that a thickness of the proximal end is greater than a thickness of the distal end.

In some embodiments, the spring support member includes a pair of alignment pegs protruding from the proximal end that is inserted in a respective pair of alignment holes on the actuable component to maintain an orientation of the spring support member relative to the actuable component during tool diameter adjustments.

In some embodiments, a fastener couples the second spring end to the spring support member that is inserted in a hole on the distal end of the spring support member.

In some embodiments, a guide member is coupled to the housing. The guide member includes a rail external to the housing that extends linearly across the exterior tool surface to at least partially define a travel path of the spring support member. The rail is configured to slidably engage the fastener to guide movement of the spring support member along the travel path between the first and second target positions of the spring support member.

In some embodiments, the guide member includes a first travel stop to couple a first rail end of the rail to the housing that corresponds to the first target position of the spring support member. A second travel stop, spaced apart from the first travel stop, couples a second rail end of the rail to the housing that corresponds to the second target position of the spring support member.

In some embodiments, the actuator is a ball screw linear actuator.

In some embodiments, the ball screw linear actuator includes a screw shaft connected to the motor that is arranged in the housing parallel relative to the tool axis.

In some embodiments, an axis of the screw shaft is aligned to the tool axis.

In some embodiments, the housing includes a cylindrically-shaped body concentric with the screw shaft.

In some embodiments, the ball screw linear actuator includes a ball nut on the screw shaft that is coupled to the hidden portion of the spring support member. The ball nut is configured to move between opposing ends of the screw shaft when the screw shaft rotates about an axis thereof.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein:

FIG. 13 is a table showing performance metrics of the decentralizer tool, according to certain embodiments.

DETAILED DESCRIPTION

Figure 1:
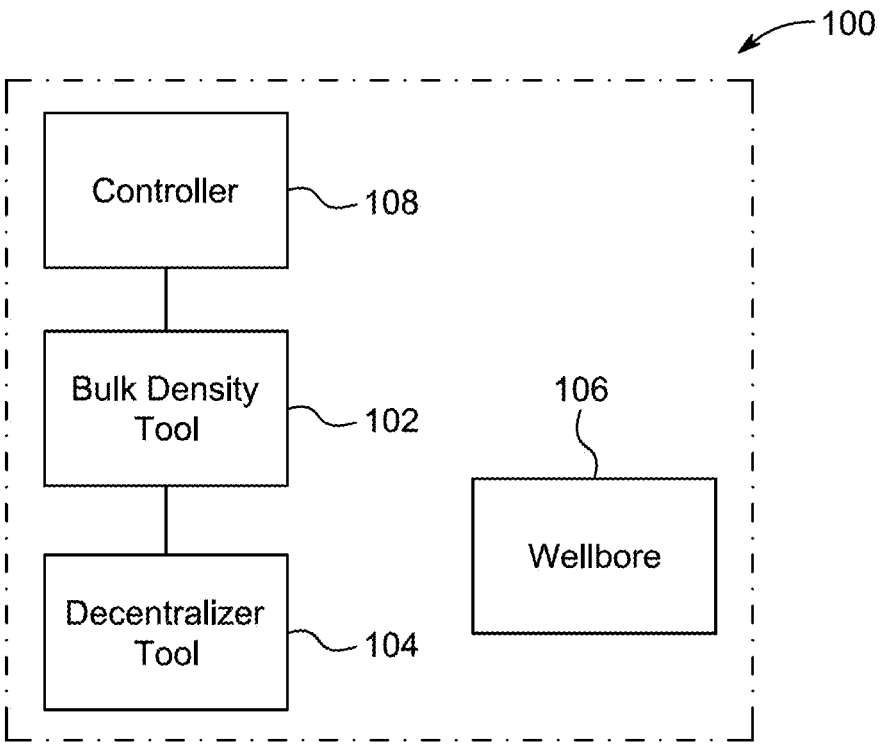
FIG. 1 is a schematic block diagram of a wireline logging system, according to certain embodiments.

In the drawings, like reference numerals designate identical or corresponding parts throughout the several views. Further, as used herein, the words "a", "an" and the like generally carry a meaning of "one or more", unless stated otherwise.

Furthermore, the terms "approximately," "approximate", "about" and similar terms generally refer to ranges that include the identified value within a margin of 20%, 10%, or preferably 5%, and any values therebetween.

Aspects of this disclosure are directed towards a decentralizer tool for use with wireline logging operations, which is sometimes referred to herein as "the DCT." The disclosed decentralizer tool is an adjustable tool including multiple interconnected components working together to provide enhanced positioning stability and consistent formation contact when deployed in conjunction with a bulk density tool for obtaining wellbore measurement data. An adapter disposed at an end of a tool housing operatively and removably couples the DCT to the bulk density tool, enabling quick and/or simple tool installation. In particular, an external spring of the DCT is configured to expand and contract to change an outer diameter of the tool, allowing operators to accommodate and maneuver the tool within various, complex wellbores during descent, measurement, and ascent operations. A motor-driven actuator internal to the tool housing provides for controlled expansion and contraction capabilities of the spring, for example, based on operator inputs provided to a controller in communication with the motor-driven actuator. As will be described in greater detail below, operation of the motor-driven actuator causes the spring to expand and contract in a controlled fashion, thereby controlling the outer tool diameter in a controlled fashion within the wellbore. In this manner, the DCT controls physical engagement between the spring and inner formations (e.g., rock formations) of the wellbore during operations. As a result, examples disclosed herein reduce tool sticking risks and/or ensure accurate tool-to-formation contact for reliable bulk density measurements across diverse geological formations. Use of the disclosed DCT with bulk density tools results in improved measurement accuracy, reduced operational downtime, and/or enhanced mechanical reliability in complex wellbore environments compared to the above-mentioned known tools.

Referring to FIG. 1, illustrated is a schematic block diagram of a wireline logging system 100, according to certain embodiments. The wireline logging system 100 is used to collect detailed information or data relating to geological formations beneath the ground surface. The wireline logging system 100 may be configured to maximize hydrocarbon recovery potential and ensure efficient and safe operations. The wireline logging system 100 includes a bulk density tool 102 configured to detect and/or measure one or more parameters associated with formation density through methods or techniques such as, for example, gamma ray attenuation, and the like. In some examples, the bulk density tool 102 determines bulk density, porosity, and/or photoelectric factor values of surrounding formations of the surface or subsurface of the earth. The bulk density tool 102 can be implemented, for example, using a gamma-gamma density logging tool, a neutron-gamma density tool, a dual-detector density sonde, and the like, any other suitable measurement tool, or a combination thereof. In one example, the bulk density tool 102 utilizes a radioactive source and one or more detectors to measure gamma rays. In another example, the bulk density tool 102 includes a neutron source that induces gamma radiation along with detectors configured to measure related scattering and/or absorption.

The wireline logging system 100 further includes a decentralizer tool 104 operatively connected to the bulk density tool 102, for example, via a mechanical connector or adapter of the tool 102. The decentralizer tool 104 provides consistent tool-to-formation contact when operated with the bulk density tool 102 in connection with a wellbore 106, essential for accurate density measurements. The decentralizer tool 104 may include multiple components to minimize transmission vibration and sticking during ascent, measurement, and/or descent operations, which will be described in greater detail below. Generally speaking, the wireline logging system 100 operates within the wellbore 106. The wellbore 106 is a drilled hole that extends downward from the ground surface of the earth to target subsurface formations beneath the ground surface. The wellbore 106 includes a drilled hole that may have a variable diameter and/or contain drilling mud, open-hole sections, and/or internal rock formations, depending on location.

The bulk density tool 102 can be suspended and conveyed into the wellbore 106, for example, via a cable mechanism of the system 100 that includes a wireline cable (e.g., an armored, multi-conductor cable). Such a cable mechanically supports the bulk density tool 102 and the DCT 104. The cable also provides electrical power and/or data transmission functionality between surface equipment and subsurface equipment including the bulk density tool 102 and the DCT 104 connected thereto. At surface level, this wireline cable is managed by a winch, hoist, and/or other lifting equipment (e.g., mounted on a logging truck or skid), which raises and lowers both of the tools 102 and 104 together within the wellbore 106.

In some examples, the system 100 of FIG. 1 also includes a controller 108 configured to control the DCT 104 or a mechanism thereof (e.g., a motor-controlled actuator). The controller 108 can be implemented, for example, using a microcontroller, a programmable logic controller (PLC), a mobile device, etc. When the DCT 104 is operatively coupled to the bulk density tool 102, a communication pathway is established between the controller 108 and the DCT 104 or the mechanism thereof, for example, via one or more signal or transmission wires, radio frequency, etc.

Figure 2A:
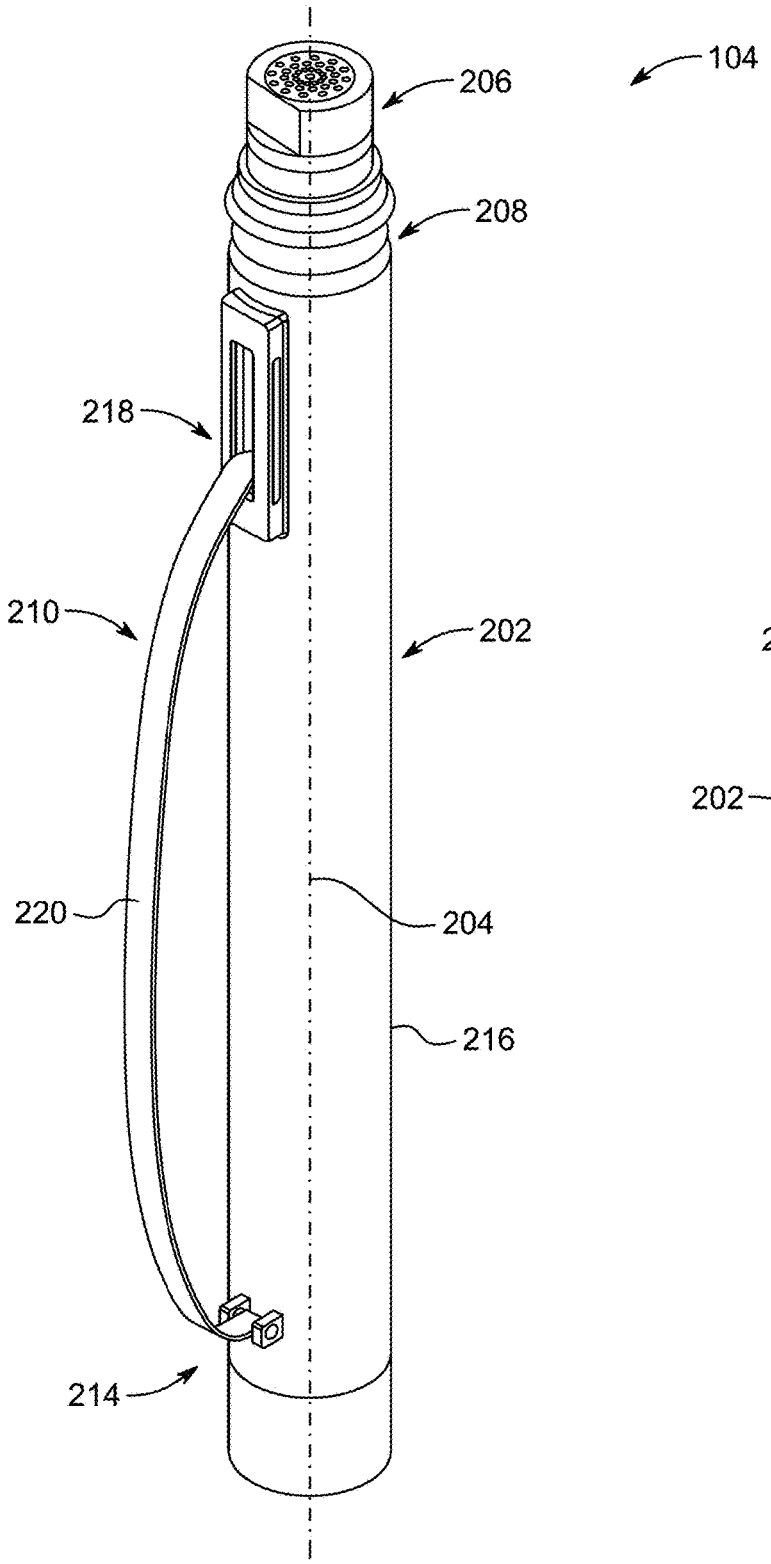
FIG. 2A is a perspective view of a decentralizer tool for use with wireline logging operations, according to certain embodiments.
Figure 2B:
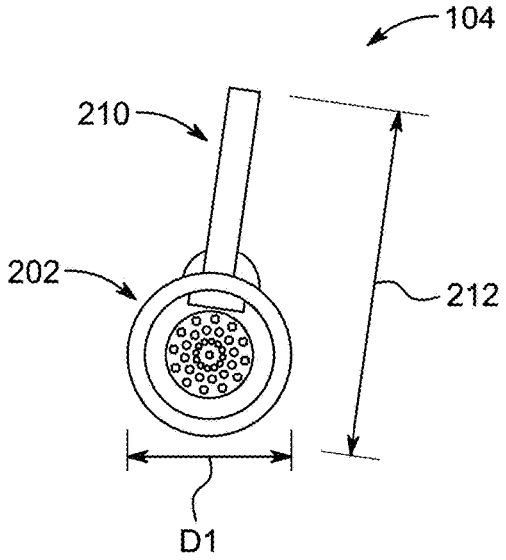
FIG. 2B is a top view of the decentralizer tool, according to certain embodiments.

Referring to FIG. 2A and FIG. 2B in combination, illustrated are a perspective view, and a top view, respectively, of the decentralizer tool 104 for use with wireline logging operations, according to certain embodiments. The decentralizer tool 104 includes a tool housing 202 sized to enter the wellbore 106 and defining a tool axis 204 of the decentralizer tool 104. The housing 202 of FIG. 2A, which may be a cylindrically-shaped housing, is configured to house and provide protection to internal components of the decentralizer tool 104. The housing 202 may be manufactured using high-strength materials, including steel, aluminum alloy, titanium, and/or composite polymer that may be selected for corrosion resistance and mechanical durability.

The decentralizer tool 104 further includes an adapter 206 connected at an end (e.g., a proximal end) 208 of the housing 202 and is configured to connect to the bulk density tool 102. The adapter 206 is a mechanical connector coupled to the end 208 of the housing 202, for example, via one or more fasteners and/or fastening methods or techniques. In some examples, the adapter 206 is provided with an interface (e.g., a mechanical interface and/or an electrical interface) compatible with and/or matching an interface of the bulk density tool 102.

The adapter 206 may include outer threads disposed thereon for mechanical attachment to the bulk density tool 102 during logging operations, such that the adapter 206 threadably and/or removably couples the DCT 104 to the bulk density tool 102 via the threads when the adapter 206 rotates relative to the bulk density tool 102. In some examples, the adapter 206 is provided with a lock mechanism that, when engaged, maintains a position and/or an orientation of the adapter 206 relative to the bulk density tool 102. In particular, the adapter 206 is configured to establish an operational or functional connection with the bulk density tool 102, in addition to a mechanical connection in which the bulk density tool 102 supports the DCT 104 through the adapter 206. That is, the adapter 206 operatively couples the DCT 104 to bulk density tool 102 and at least one device external to the wellbore 106, such as a controller configured to communicate with the DCT 104 and/or provide electrical power to the DCT 104.

The decentralizer tool 104 further includes a spring (e.g., a bow spring) 210 operatively coupled to the housing 202. The spring 210 is externally positioned relative to the housing 202 and partially defines an outer diameter 212 of the decentralizer tool 104, where the housing 202 of FIG. 2B has an outer diameter 'Dl'. That is, the outer diameter 212 of the DCT 104 is fully defined by a combination of the spring 210 and the housing 202.

The spring 210 includes a first spring end 214 coupled to an exterior tool surface 216 of the housing 202. The spring 210 further includes a second spring end 218, opposite to the first spring end 214, that is external to the housing 202. The second spring end 218 is spaced apart from the first spring end 214 by a certain distance, based on spring length and curvature parameters. The spring 210 also includes an intermediate spring section 220 between the first spring end 214 and the second spring end 218, which advantageously engages and disengages from different structures within the wellbore 106 during tool operation.

The first spring end 214 is attached to the exterior tool surface 216 of the housing 202, for example, via one or more fasteners and/or fastening methods or techniques. The first spring end 214 may be secured through welded joints, threaded fasteners, or may be integrally manufactured. In some examples, the first spring end 214 is pivotably connected to the housing 202, for example, via a movable joint (e.g., a pin joint) interposed between the first spring end 214 and the exterior tool surface 216. The second spring end 218 extends external to the housing 202 within proximity to an internal actuator for controlling the position of the second spring end 218. In particular, movement of the second spring end 218 relative to the first spring end 214 results in radial spring displacement during expansion and contraction cycles of the spring 210. The intermediate spring section 220 of FIG. 2A is substantially between the first spring end 214 and the second spring end 218 and is moveable (a) toward tool axis 204 when the spring 210 contracts and (b) away from the tool axis 204 when the spring 210 expands.

The spring 210 is configured to partially define the outer diameter 212 of the decentralizer tool 104. The spring 210 is a part of the outer diameter 212 of the decentralizer tool 104. The spring 210 is configured to provide variable radial extension capabilities based on operating forces applied to the opposing ends 214 and 218 of the spring 210, allowing the controller 108 to adjust the outer diameter 212 based on operational requirements, for example, by controlling a motor internal to the housing 202. The spring 210 exerts a resistive force proportional to its displacement from the equilibrium position, defined by Hooke's Law:

$$F_s=-k*x$$

where:

$F_s$ is the spring force in (N), k is the spring constant in (N/m), and x is the displacement from the equilibrium in (m).

In an embodiment, potential energy stored within the compressed or extended state of the spring 210 is defined as:

$$U=(\tfrac{1}{2}*k*x^2)$$

where:

U is the stored potential energy in Joules (J), k is the spring constant in (N/m), and x is the displacement from the equilibrium in (m).

In a preferred embodiment, the spring 210 includes a bow spring. The spring 210 has a curved or arc-shaped configuration that provides controlled radial force distribution. The spring 210 may be manufactured from materials including, for example, stainless steel or other durable alloys that maintain shape and dimensional stability under repeated use.

Figure 3:
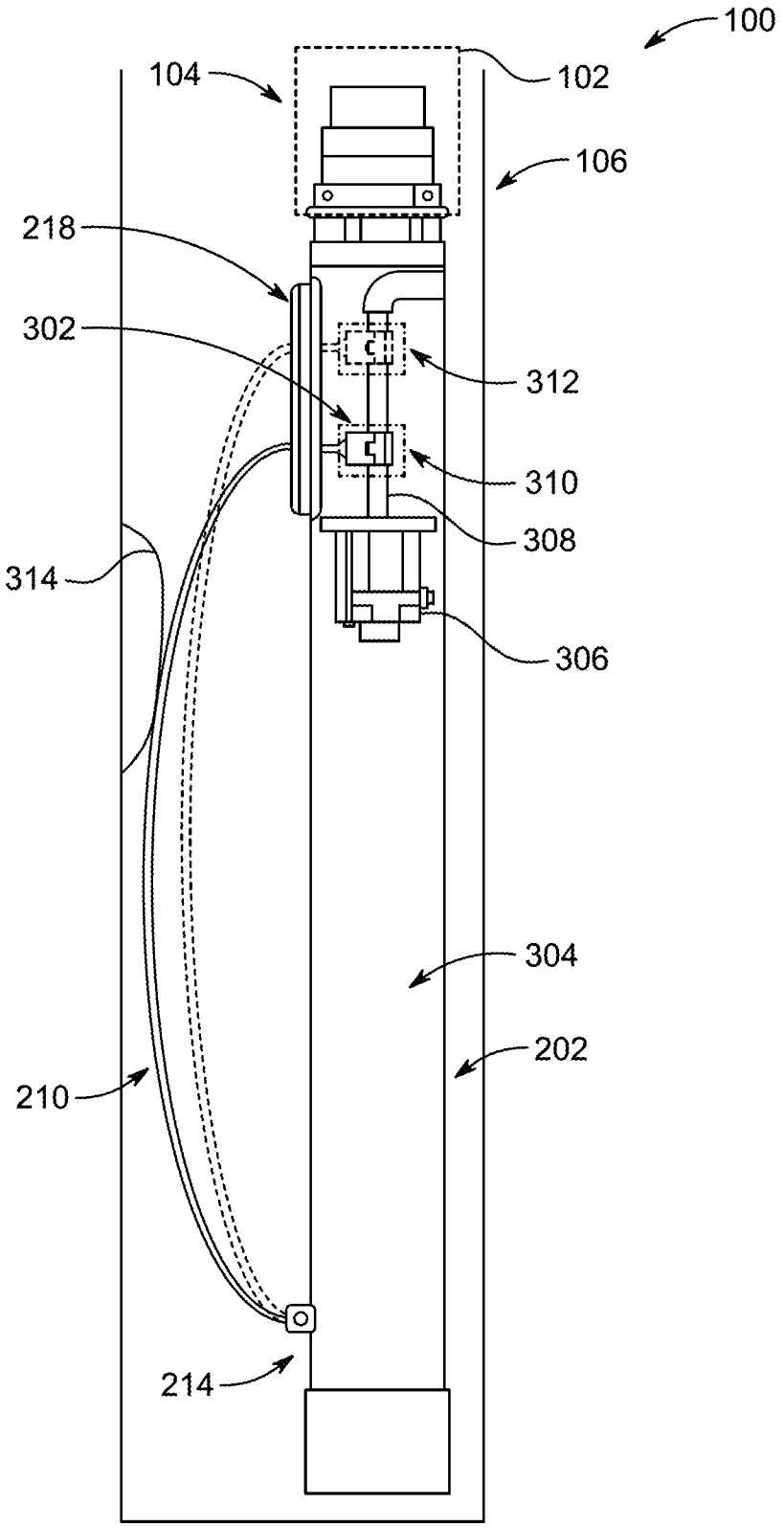
FIG. 3 is a side view showing the decentralizer tool disposed within a wellbore, according to certain embodiments.

Referring to FIG. 3, illustrated is a side view of the decentralizer tool 104 disposed within the wellbore 106, according to certain embodiments. In the illustrated example of FIG. 3, the DCT 104 is connected to the bulk density tool 102. The bulk density tool 102 (represented by the dotted/dashed lines of FIG. 3) is supporting the decentralizer tool 104 through the adapter 206, where each of the bulk density tool 102 and the decentralizer tool 104 is suspended in the wellbore 106 via equipment of the system 100. The decentralizer tool 104 further includes a spring support member 302, which provides a reliable connection between the second spring end 218 and an actuable component within the tool housing 202 through which operating forces are transferable. The spring support member 302 allows for precise linear motion of the second spring end 218 along the tool axis 204 to compress and decompress the spring 210, thereby controlling radial engagement with an inner wall of the wellbore 106.

For purpose of controlling a state of the spring 210, the decentralizer tool 104 further includes a motor (e.g., an electric motor) 306 internal to the housing 202 that is operatively coupled to the controller 108, such that the motor 306 is operable by the controller 108. For example, the controller 108 is communicative coupled, via a communication link, to the motor 306 to provide control signals or commands and/or electrical power to the motor 306, thereby controlling the motor 306 to generate a motor output (e.g., a torque). The communication link may be partially formed by the adapter 206 or independent of the adapter 206.

In some examples, the motor 306 of FIG. 3 is positioned within an internal cavity 304 of the housing 202. The motor 306 is an electro-mechanical device that generates the motor output for compressing and/or decompressing the spring 210, which is applied to the second spring end 218 through the spring support member 302 to control the diameter 212 of the decentralizer tool 104 based on corresponding changes in spring state of the spring 210. The motor 306 is electrically connected to a power source for supplying operational power to the motor 306. In one example, the power source includes a battery internal to the tool housing 202. Additionally or alternatively, in another example, the power source is an electrical generator, an electrical panel, a grid-powered electrical device, and/or any other suitable source of electrical power positioned external to the wellbore 106 and connected to the motor 306 through the functional connection created by the adapter 206.

The decentralizer tool 104 further includes an actuator (e.g., a ball screw linear actuator) 308 operatively interposed between the spring support member 302 and the motor 306. The actuator 308 is a mechanical device configured to convert rotational motion of the motor 306 into controlled linear motion of the second spring end 218. In some examples, the actuator 308 is provided with lead screw assemblies, hydraulic cylinders, and/or pneumatic pistons designed to facilitate precise linear displacement control.

The actuator 308 is configured to move, via the motor output of the motor 306, the spring support member 302 in an axial direction along the tool axis 204 between a first target position (e.g., an end position) 310 of the spring support member 302 and a second target position (e.g., an end position) 312 of the spring support member 302 to change the state of the spring 210. Each of the first target position 310 and the second target position 312 are represented by dotted/dashed lines in FIG. 3.

In some examples, the movement of the spring support member 302 towards the first target position (i.e., towards the first spring end 214) causes the intermediate spring section 220 to expand toward an inner wall formation or structure (e.g., a rock formation) 314 of the wellbore 106 to engage the inner wall structure 314. As shown in FIG. 3, the spring support member 302 is in the first target position thereof, which corresponds to an expanded state of the spring 210 in which the inner wall structure 314 imparts a force on the intermediate spring section 220 urging the DCT 104 and the bulk density tool 102 to move away from the inner wall structure 314. Such engagement may result in the DCT 104 and the bulk density tool 102 moving towards a wall area of the wellbore 106 opposite to the inner wall structure 314 until the bulk density tool 102 is secured in a stable position for measurements, which substantially improves measurement accuracy.

On the other hand, in some examples, the movement of the spring support member 302 toward the second position (i.e., away from the first spring end 214) causes the intermediate spring section 220 to contract away from the inner wall structure 314 to disengage from the inner wall structure 314, allowing the DCT 104 and the bulk density tool 102 to easily maneuver around and/or traverse the formation 314. The second target position of the spring support member 302, along with a corresponding representation of the spring 210 in a contracted state thereof, is represented by the dotted/dashed lines of FIG. 3. In this manner, the DCT 104 can selectively engage with and disengage from formations of interest within the wellbore 106 in an effective manner, depending on a stage of the wireline logging operation.

The actuator 308 is mechanically coupled to the motor 306 and configured to transmit the motor output into a mechanical displacement of the spring support member 302. The actuator 308 facilitates axial movement of the spring support member 302 along the tool axis 204 between the first target position 310 and the second target position 312. The motor 306 and the actuator 308, together, provide controlled compression and extension cycles of the spring 210.

In some examples, the axial displacement of the spring support member 302 along the tool axis 204 in a direction toward the first spring end 214 causes the intermediate spring section 220 to undergo radial expansion where the intermediate spring section 220 moves toward the inner wall structure 314 of the wellbore 106. The axial movement of the spring support member 302 in an opposite direction along the tool axis 204 away from the first spring end 214 causes the intermediate spring section 220 to undergo radial contraction and withdraws the intermediate spring section 220 from the inner wall structure 314. Such motion of the spring support member 302 results in advantageous engagement and disengagement the spring 210 from the wellbore 106.

The motor 306 generates the torque required to overcome the resistance of the spring 210, defined by:

$$T_m = F_s * r$$

where:

$T_m$ is the torque generated by the motor 306 in (Nm), $F_s$ is the resistive force in (N), and r is the effective radius of a shaft of the motor 306 in (m).

The rotational speed conversion from revolutions per minute (RPM) to radians per second (rad/s) is expressed as:

$$\omega = (2 * \pi * RPM)/60$$

where:

ω is the angular velocity in (rad/s), and

RPM is the rotational speed of the motor 306 in (revolutions per minute).

The power required for the motor 306 is calculated using:

$$P_m = T_m * \omega$$

where:

$P_m$ is the power required by the motor 306 in (W), $T_m$ is the torque applied by the motor 306 in (Nm), and ω is the angular velocity of the motor 306 in (rad/s).

Figure 4:
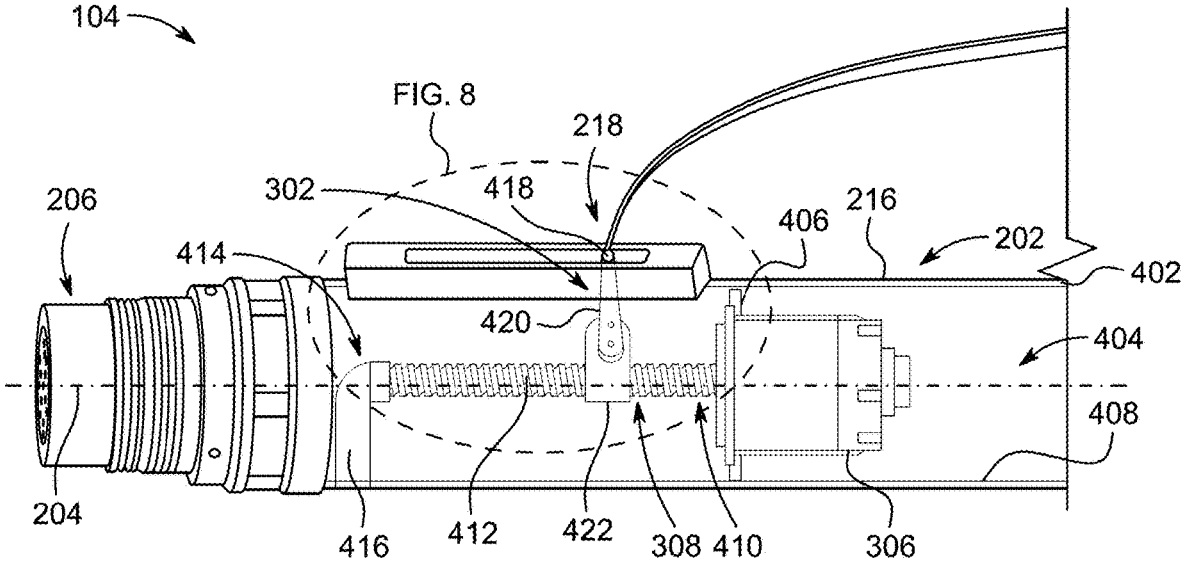
FIG. 4 is a partial sectional view of the decentralizer tool showing internal components, according to certain embodiments.

Referring to FIG. 4, illustrated is a partial sectional view of the decentralizer tool 104 showing internal components, according to certain embodiments. The tool housing 202 includes a circumferential wall 402 defining a tool bore 404 in which the motor 306 and/or the actuator 308 is centrally disposed. The circumferential wall 402 is a relatively thin, rigid wall of the housing 202 surrounding and/or concentric with the tool axis 204, which provides structural integrity to the DCT 104. In the illustrated example of FIG. 4, the cylindrically-shaped body of the housing 202 has the circumferential wall 402. The tool bore 404 extends longitudinally through the housing 202 along the tool axis 204. The tool bore 404 is configured to receive and securely retain the motor 306 and the actuator 308 in a centrally disposed position relative to the tool axis 204, where the tool axis 204 is aligned to at least one motor component and/or at least one actuator component.

The circumferential wall 402 may be manufactured of rigid materials, including a metal, alloy, or polymer composite selected to withstand operational loads and vibrational forces generated during operation of the motor 306 or the actuator 308.

The housing 202 further includes a motor support bracket 406 interposed between the motor 306 and the circumferential wall 402, which facilitates maintaining precise motor positioning during tool diameter adjustments. The motor support bracket 406 couples the motor 306 to an inner surface 408 of the circumferential wall 402 such that a motor output portion 410 of the motor 306 is concentric with the circumferential wall 402. The inner surface 408 is positioned on the circumferential wall 402 opposite relative to the exterior surface 216. A coupling between the support bracket 406 and the motor 306 can be achieved, for example, via one or more fasteners and/or fastening methods or techniques. Further, a coupling between the support bracket 406 and the circumferential wall 402 can be achieved, for example, via one or more fasteners and/or fastening methods or techniques. The output portion 410 of the motor 306, which is concentric with the circumferential wall 402, includes a motor shaft substantially aligned to the tool axis 204.

The motor support bracket 406 mechanically couples the motor 306 to the inner surface 408 of the circumferential wall 402. In some examples, the motor support bracket 406 includes multiple mounting points distributed circumferentially around the inner surface 408 and/or radially relative to the tool axis 204. In such examples, each of the multiple mounting points may include threaded fasteners, or welded joints to attach the motor 306 to the housing 202. The motor support bracket 406 maintains precise alignment such that the motor output portion 410 remains concentric with the circumferential wall 402.

The motor output portion 410 extends from the motor 306 and is positioned to transmit rotational motion to downstream components within the decentralizer tool 104 corresponding to the actuator 308. In some examples, the motor output portion 410 is rotatable about a rotation axis defined by the motor 306 in clockwise and counterclockwise directions. The concentric alignment of the motor output portion 410 with the circumferential wall 402 facilitates efficient power transmission while minimizing mechanical stress concentrations.

The actuator 308 of FIG. 4 includes a rotatable component (e.g., a shaft) 412 operatively connected to the motor output portion 410 of the motor 306, such that the motor output portion 410 and the rotatable component 412 rotate in tandem about the rotation axis during actuator operations. The rotatable component 412 extends linearly away from the motor output portion 410 toward the adapter 206 such that the rotatable component 412 is concentric with the circumferential wall 402. In particular, the rotatable component 412 creates a linear path, between opposing ends of the rotatable component 412, across which the output of the motor 306 is transferable from the rotatable component 412 to a different actuable component (e.g., a ball nut) of the actuator 308 associated with controlling spring position. The rotatable component 412 extends in a linear direction away from the motor output portion 410 and/or projects toward the adapter 206. The rotatable component 412 is positioned to remain concentric with the circumferential wall 402 of the housing 202 and may provide rotational balance and/or minimize eccentric loading conditions during operation.

The actuator 308 further includes an actuator support member 416 protruding from the inner surface 408 of the circumferential wall 402 in a radially inward direction toward the tool axis 204. The actuator support member 416 is configured to rotatably support an end 414 of the rotatable component 412 of the actuator 308, for example, by slidably engaging the end 414 of the rotatable component 412. The actuator support member 416 protrudes radially inward from the inner surface 408 of the circumferential wall 402 towards the tool axis 204. The actuator support member 416 provides rotational support for the end 414 of the rotatable component 412. The actuator support member 416 facilitates smooth rotational motion of the rotatable component 412 and maintains precise axial alignment. In some examples, the actuator support member 416 defines a receptacle (e.g., a circular opening) therein that is substantially aligned to the tool axis 204. In such examples, the receptacle is shaped and/or sized to receive the end 414 of the rotatable component 412 in the receptacle, where the end 414 remains in the receptacle throughout rotary motions.

In some embodiments, the spring support member 302 includes an exposed portion 418 coupled to the second spring end 218 and a hidden portion 420 internal to the housing 202 that is connected to the exposed portion 418. The exposed portion 418 extends outward from the housing 202 and provides an accessible connection point for the second spring end 218. The exposed portion 418 is configured to allow adjustments or maintenance of the spring 210. The exposed portion 418 enables users to inspect the connection of the spring 210 and make necessary modifications without the need to disassemble the housing 202.

The hidden portion 420 remains substantially enclosed within the housing 202, such that the hidden portion 420 is not easily visible to a person using the DCT 104. The hidden portion 420 may include mounting features to facilitate proper alignment of the spring 210. The hidden portion 420 provides structural support and stability to the spring support member 302. The hidden portion 420 of the spring support member 302 may further protect the internal components from environmental and mechanical damage.

In some examples, the actuator 308 is a ball screw linear actuator. In such examples, the ball screw linear actuator includes a screw shaft, which corresponds to the rotatable component 412, connected to the motor 306 that is arranged in the housing 202 parallel relative to the tool axis 204. In such examples, the screw shaft includes an axis aligned to the tool axis 204.

The ball screw linear actuator is a mechanical linear motion device that converts rotational motion into a precise linear motion with minimal friction. The screw shaft of the ball screw linear actuator is mechanically connected to the motor 306 to provide a direct drive configuration for efficient power transmission. A coupling between the screw shaft and the motor output portion 410 can be achieved, for example, via one or more fasteners and/or fastening methods or techniques. The screw shaft is specifically arranged within the housing 202 in a parallel orientation relative to the tool axis 204.

The ball screw linear actuator further includes a ball nut operatively coupled to the screw shaft. The ball nut is also fixedly coupled to the hidden portion 420 of the spring support member 302. In particular, the ball nut is configured to move between opposing ends of the screw shaft when the screw shaft rotates about the rotation axis.

The ball nut is positioned on the screw shaft and configured to maintain a secure coupling connection to the hidden portion 420 of the spring support member 302. The ball nut is specifically designed to execute controlled linear movement between the opposite ends of the screw shaft in response to the motor 306 generating the output thereof. As the screw shaft rotates together with the motor output portion 410, the ball nut converts the rotational screw shaft motion into a precise linear displacement, for example, via one or more ball members slidably engaged between the screw shaft and the ball nut. The ball nut provides accurate positioning control and efficient force transmission within the operational range of the actuator 308, making it suitable for applications requiring precise linear motion control and reliable mechanical performance.

In some embodiments, the cylindrically-shaped body of the housing 202 is concentric with the screw shaft of the actuator 308, so that the cylindrically-shaped body surrounds the screw shaft. The screw shaft is configured such that its longitudinal axis is precisely aligned with the tool axis 204, creating a coaxial arrangement that minimizes lateral forces and reduces potential binding or misalignment issues during linear actuation cycles.

In some embodiments, the actuator 308 further includes an actuable component 422. The actuable component 422 is a movable component of the actuator 308 that is configured to connect the spring support member 302 to the rotatable component 412. In some examples, the actuable component 422 corresponds to the ball nut, as previously described. As such, the actuable component 422 may be slidably disposed on the rotatable component 412 and operatively coupled thereto, where rotation of the rotatable component 412 about the associated rotation axis causes the actuable component 422 to move axially along the rotatable component 412 between opposing ends of the rotatable component 412. Stated differently, the rotatable component 412 is configured to slide along the rotatable component 412 in response to the rotatable component 412 rotating relative to the actuable component 422, a linear direction of which is based on a rotational direction of the rotatable component 412. In such examples, the actuable component 422 is also fixedly coupled to the spring support member 302, such that the actuable component 422 and the spring support member 302 move together during actuation. In the illustrated example of FIG. 4, the spring support member 302 extends away from actuable component 422 and passes through an opening (e.g., the opening 502 of FIG. 5A) of the tool housing 202 to expose at least a portion of the spring support member 302.

Figure 5A:
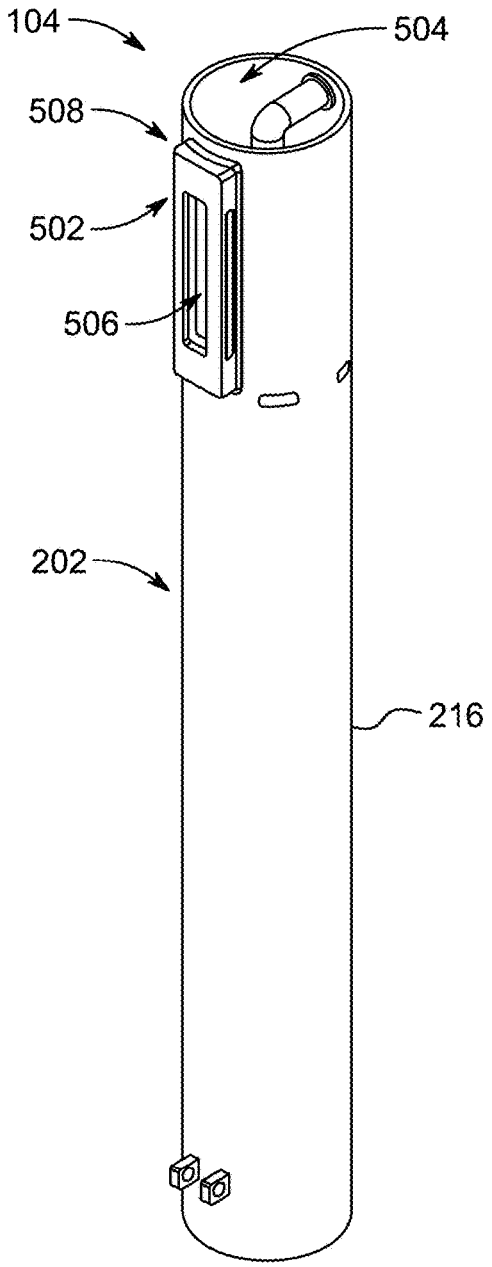
FIG. 5A is a perspective view of the decentralizer tool showing an opening therein, according to certain embodiments.
Figure 5B:
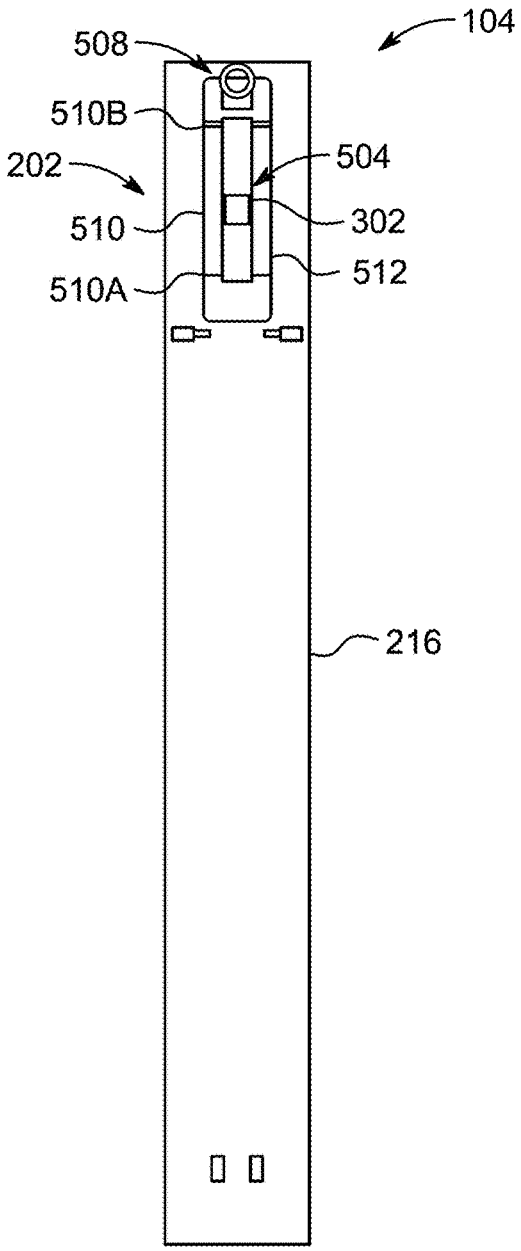
FIG. 5B is a side view of the decentralizer tool showing the opening therein, according to certain embodiments.

Referring to FIG. 5A, and FIG. 5B in combination, illustrated are a perspective view of the DCT 104 and a side view of the DCT 104, respectively, showing a housing opening 502 therein, according to certain embodiments. The adapter 206 and the spring 210 have been removed for clarity. The opening 502 is disposed on the exterior surface 216 of the housing 202, partially exposing or revealing an enclosed cavity 504 defined by the housing 202 to an outside environment. The opening 502 of the housing 202 includes, for example, an elongated slot 506 arranged along the exterior tool surface 216 substantially parallel to the tool axis 204. The elongated slot 506 extends axially between opposite ends of the housing 202 across a certain distance corresponding to a travel distance of the spring support member 302. The opening 502 of the housing 202 generally exposes or reveals an area of the enclosed cavity 504 that is configured to accommodate the spring support member 302 within its operational range of motion. The elongated slot 506 is configured to facilitate linear translation of the spring support member 302 along a predetermined travel path of the spring support member 302 between opposite ends of the elongated slot 506.

The spring support member 302 passes through the opening 502 and/or extends through the opening 502 from the second spring end 218 to the actuable component 422 of the actuator 308. The actuable component 422 is operatively coupled to the spring support member 302 for force transmission to the second spring end 218 through the spring support member 302 during actuation of the actuable component 422. The substantially enclosed configuration provides a suitably safe environment within the enclosed cavity 504 in which moving components can function.

In some embodiments, a guide member 508 is coupled to the housing 202, which facilitates guiding relative motion of the spring support member 302 throughout actuator operations. The guide member 508 includes one or more rails protruding from the exterior tool surface 216 that are configured to slidably engage the spring support member 302, thereby limiting movement of the spring support member 302 and/or urging the spring support member 302 to move in one or more predefined directions. For example, a rail 510 external to the housing 202 extends linearly across the exterior tool surface 216 to at least partially define a travel path of the spring support member 302.

The guide member 508 is a structural component configured to direct and restrict the movement of connected components. The guide member 508 is coupled to the housing 202, for example, via one or more fasteners and/or fastening methods or techniques. In some examples, a bolt or a screw, a snap-fit mechanism, and the like can be utilized to secure the guide member 508 or a component thereof to the housing 202. The guide member 508 may include channels or grooves to prevent lateral displacement and permit linear movement. In some examples, the guide member 508 is integrally formed with the housing 202, such that the housing 202 and the guide member 508, together, form a one-piece component.

The rail 510 is a linear guide component external to the housing 202 that extends across the exterior tool surface 216 between a first rail end 510A of the rail 510 and a second rail end 510B of the rail 510 opposite to the first rail end 510A. The rail 510 extends linearly across the exterior tool surface 216 in a predefined direction parallel to the elongated slot 506. The rail 510 is configured to provide precise guidance and constraints for the linear motion of the spring support member 302 to ensure accurate positioning and prevent lateral deviation during operation.

The rail 510 may be a first rail of a pair of rails. In some examples, aspects depicted in connection with the first rail 510 likewise apply to one or more other rails of the guide member 508. For example, a second rail 512 is spaced apart from the first rail 510 by a distance corresponding to a width of the spring support member 302, such that the spring support member 302 is slidably interposed between the first rail 510 and the second rail 512.

Figure 6A:
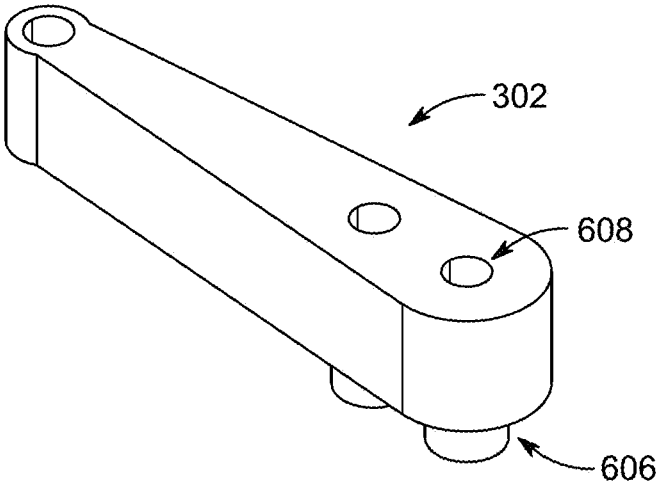
FIG. 6A is a perspective view of a spring support member, according to certain embodiments.
Figure 6B:
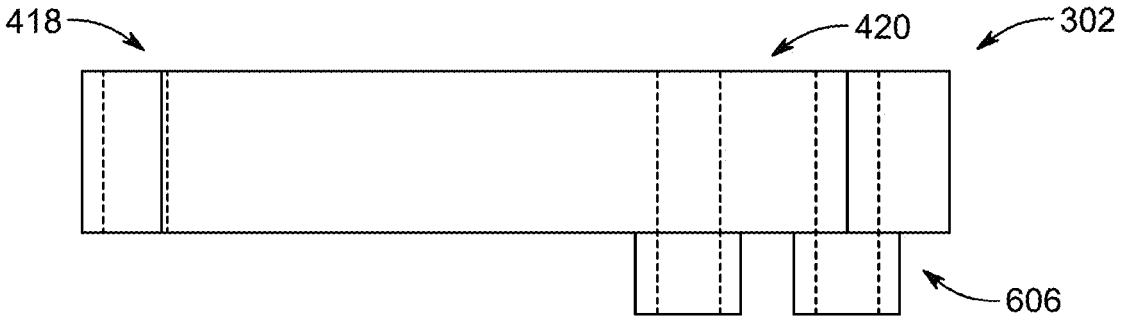
FIG. 6B is a side view of the spring support member showing a protruding pair of alignment pegs, according to certain embodiments.
Figure 6C:
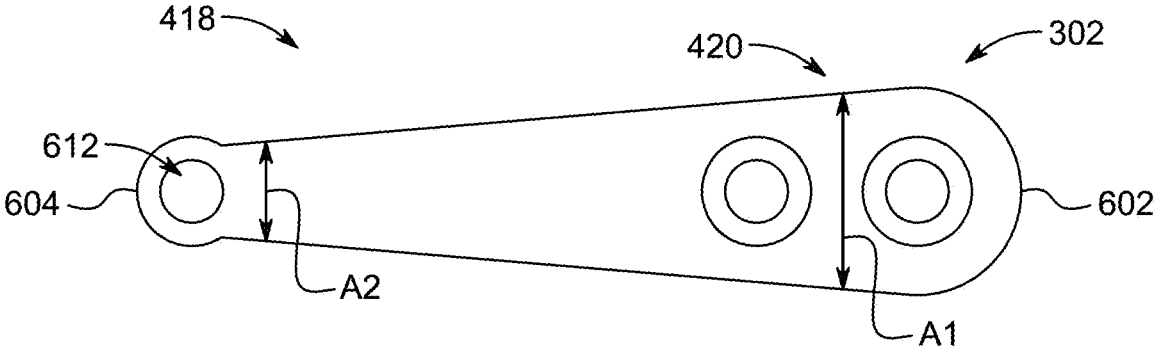
FIG. 6C is a side view of the spring support member showing holes therein, according to certain embodiments.

Referring to FIG. 6A, FIG. 6B and FIG. 6C, illustrated are a perspective view, a side view, and another side view, respectively, of the spring support member 302 showing a protruding pair of alignment pegs 606 and holes 608 therein, according to certain embodiments. In some examples, the hidden portion 420 of the spring support member 302 includes a proximal end 602 of the spring support member 302, which is configured to be disposed in the enclosed cavity 504 and connected to the actuable component 422. In some examples, the exposed portion 418 of the spring support member 302 includes a distal end 604 of the spring support member 302, which is configured to be disposed externally relative to the enclosed cavity 504 and connected to the second spring end 218 of the spring 210. The proximal end 602 may include a mounting interface, at least partially formed by the alignment pegs 606, that is configured to mechanically couple with the actuable component 422 through fastening mechanisms, such as threaded connections, press-fit assemblies, and/or interlocking features that ensure secure attachment during operational loading cycles.

The distal end 604 is specifically designed to receive and retain the second spring end 218, for example, via a fastener (e.g., the fastener 702 of FIG. 7) passing through a hole 612 of the spring support member 302 disposed at or near the distal end 604. The distal end 604 facilitates direct access for installation, replacement or tension adjustment of the spring 210. The spring support member 302 provides a continuous load path for transmitting forces between the spring 210 and the actuable component 422. This configuration enables the spring support member 302 to function as both a structural bridge and an accessible service interface for the spring 210.

The spring support member 302 includes at least two alignment pegs thereon, such as the pair of alignment pegs 606 protruding from the proximal end 602. That is, each of the alignment pegs 606 is positioned on the spring support member 302 at or near the proximal end 602 and extends away therefrom. The pair of alignment pegs 606 are insertable in respective alignment holes 608 (FIG. 9B) disposed on the actuable component 422 to maintain the orientation of the spring support member 302 relative to the actuable component 422 during adjustments of the outer diameter 212 of the decentralizer tool 104.

The at least two alignment pegs 606 provide an alignment mechanism configured to maintain operational stability during adjustment of the spring support member 302. Each of the alignment pegs 606 extends axially from the proximal end 602 perpendicular relative to a central axis of the spring support member 302. In a preferred embodiment, the spring support member 302 includes one pair of alignment pegs 606. However, in some examples, the spring support member 302 is implemented using one or more additional and/or different alignment pegs. In some examples, the alignment pegs 606 are cylindrically shaped for secure engagement with the respective alignment holes 608 or surface features defining the alignment holes 608. Each of the alignment holes 608 is sized, shaped, and/or positioned to receive a respective one of the alignment pegs 606 in a complementary interference fit. The mechanical coupling arrangement prevents rotational and lateral displacement between the spring support member 302 and the actuable component 422 during operational cycles.

During adjustment of the outer diameter 212 of the decentralizer tool 104, the mechanical coupling created by engagement between the alignment pegs 606 and the actuable component 422 via the alignment holes 608 prevents misalignment that may compromise the functionality of the spring 210.

In some embodiments, the spring support member 302 is tapered such that a thickness of the proximal end 602 is greater than a thickness of the distal end 604. According to an embodiment, the proximal end 602 has a thickness 'A1' and the distal end 604 has a thickness 'A2', such that the thickness 'A1' is greater than the thickness 'A2'.

Figure 7:
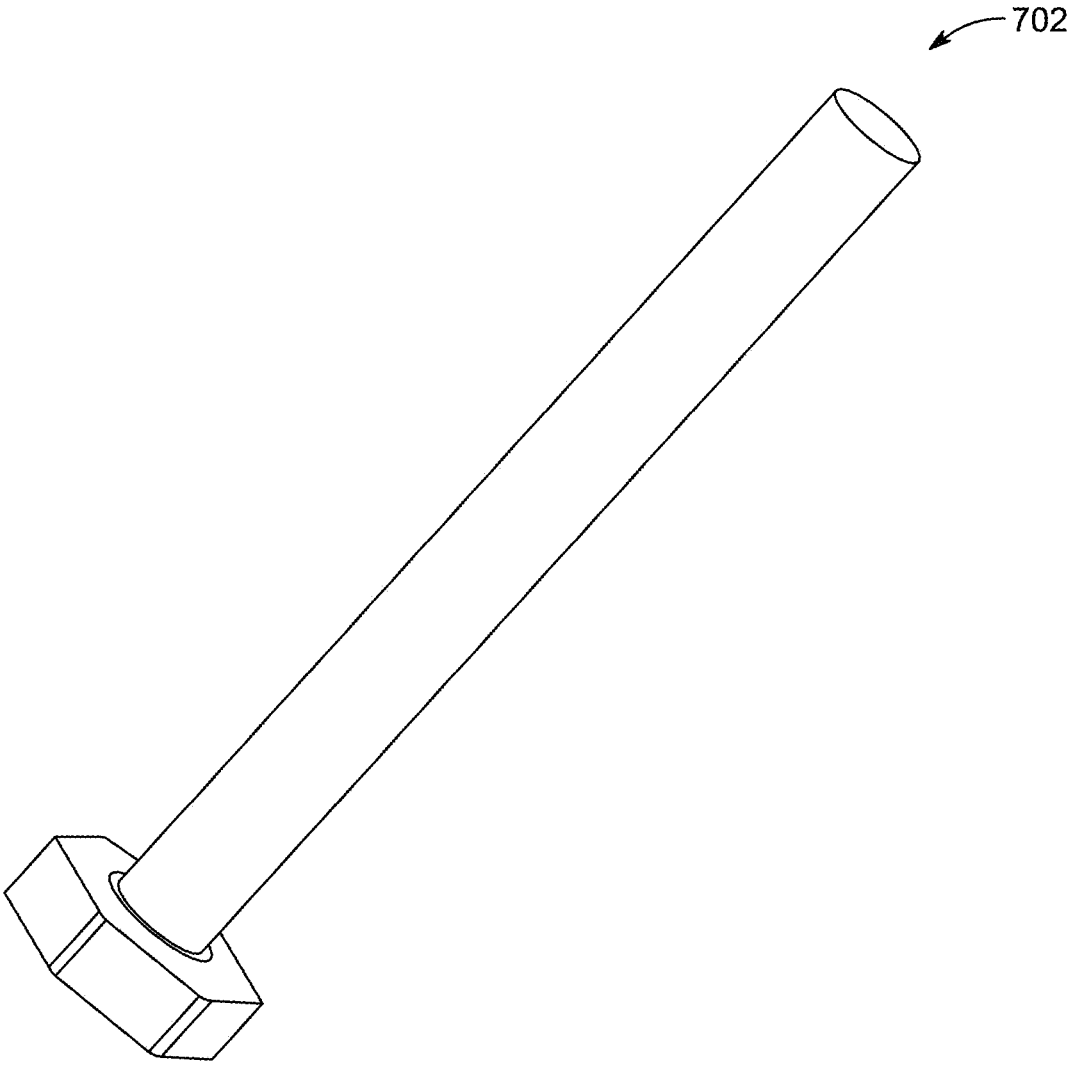
FIG. 7 is a perspective view of a fastener for coupling a second spring end to a spring support member, according to certain embodiments.

Referring to FIG. 7, illustrated is a perspective view of a fastener 702, for coupling the second spring end 218 to the spring support member 302, according to certain embodiments. The fastener 702 couples the second spring end 218 to the spring support member 302. The fastener 702 is insertable in the hole 612 on the distal end 604 of the spring support member 302, which pivotably attaches the fastener 702 to the distal end 704. The fastener 702 is also insertable in a hole on the second spring end 218, which pivotably attaches the fastener 702 to the second spring end 218. The fastener 702 is a mechanical coupling device specifically designed to establish a secure connection between the second spring end 218 and the spring support member 302 and may be used in conjunction with one or more other fastening components such as, for example, a nut, a washer, a rivet, and the like, or a combination thereof. The fastener 702 may be manufactured of a metal selected for corrosion resistance and provide structural integrity under operational loads.

The fastener 702 includes a shaft (e.g., a partially threaded shaft) configured to provide secure mechanical engagement with respect to material forming the hole 612 of the spring support member 302 and/or the hole of the second spring end 218. The fastener 702 further includes a head (e.g., a hexagonal head) configured to engage with the first rail 510 and/or the second rail 512. The fastener 702 may operate through an insertion-based attachment mechanism.

Figure 8:
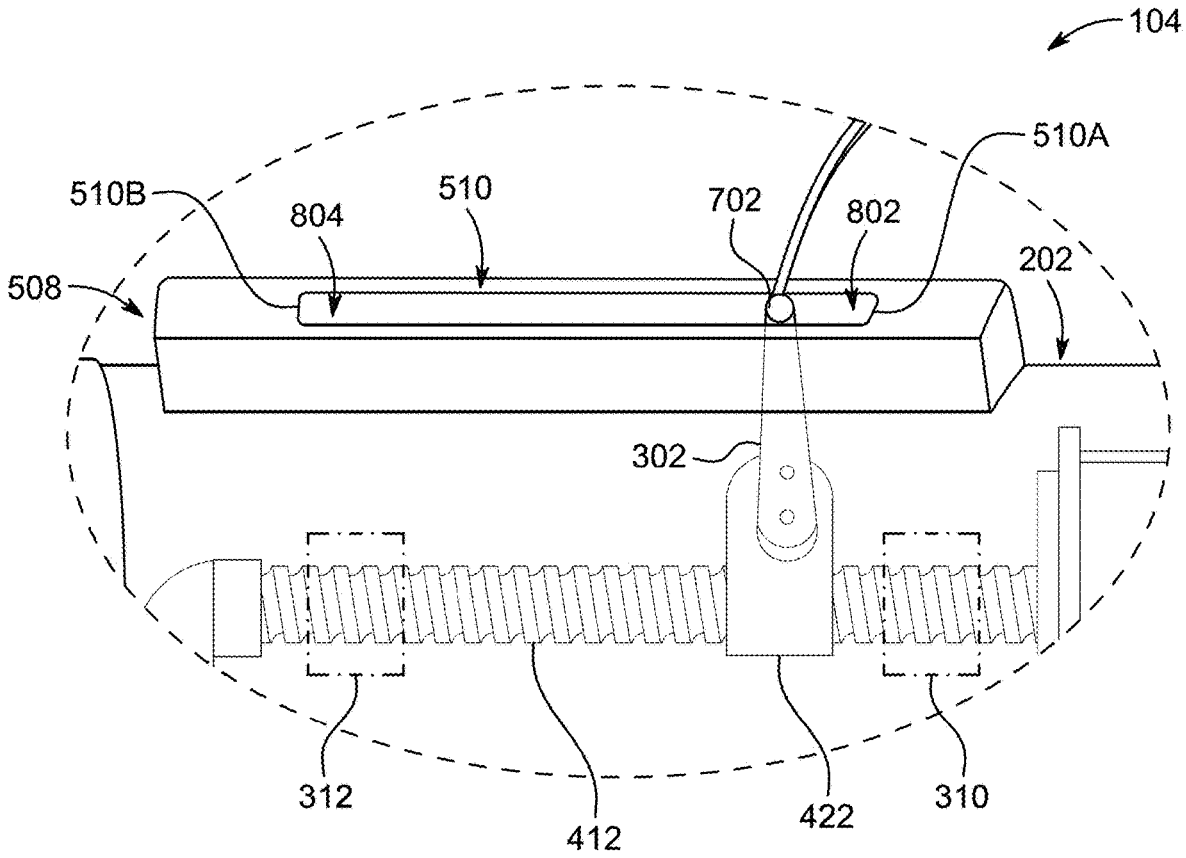
FIG. 8 is an enlarged view of a portion of FIG. 4 showing the spring support member between target positions thereof, according to certain embodiments.

Referring to FIG. 8, illustrated is an enlarged view of a portion of FIG. 4 showing the spring support member 302 between target positions thereof, according to certain embodiments. The first target position 310 of FIG. 8 may correspond to a first target position of the actuable component 422, while the second target position 312 of FIG. 8 may correspond to a second target position of the actuable component 422. According to the illustrated example of FIG. 8, rotation of the rotatable component 412 about the associated rotation axis in a first direction (e.g., a clockwise direction) drives the actuable component 422 to move the spring support member 302 toward the first target position 310. On the other hand, rotation of the rotatable component about the associated rotation axis in a second direction (e.g., a counterclockwise direction) drives the actuable component 422 to move the spring support member 302 toward the second target position 312.

In the illustrated example of FIG. 8, the first rail 510 and/or the second rail 512 is/are configured to slidably engage the fastener 702 to guide movement of the spring support member 302 along the travel path between the first target position 310 and the second target position 312. The rail(s) 510, 512 provide a linear surface that prevents undesired lateral movement of the spring support member 302. The fastener 702 is configured to maintain mechanical coupling between the rail(s) 510, 512 and the spring support member 302 for precise positioning between the first target position 310 and the second target position 312 on the rotatable component 412 of the actuator 308.

In some examples, the guide member 508 includes a first travel stop 802 coupling the first rail end 510A of the rail 510 to the housing 202 that corresponds to the first target position 310 of the spring support member 302. The guide member 508 further includes a second travel stop 804, spaced apart from the first travel stop 802, coupling the second rail end 510B of the rail 510 to the housing 202 that corresponds to the second target position 312 of the spring support member 302. In such examples, the first travel stop 802 and the second travel stop 804 are positioned at opposite sides of the respective rail(s) 510, 512 and, together, define the operational boundaries for the movement of the spring support member 302. The first travel stop 802 and the second travel stop 804 are configured to engage the fastener 702 or part thereof to limit movement of the spring support member 302. That is, the first and second travel stops 802 and 804 physically prevent the spring support member 302 from exceeding the operational boundaries of range. In one example, the first travel stop 802 engages the fastener 702 and/or the spring support member 302 to prevent axial movement beyond the first target position 310. In another example, the second travel stop 804 engages the fastener 702 and/or the spring support member 302 to prevent axial movement beyond the second target position 312. The spacing between the first travel stop 802 and the second travel stop 804 determines the maximum displacement distance available for the spring support member 302 during expansion and contraction cycles.

In some examples, the first travel stop 802, the second travel stop 804, and the rail(s) 510, 512 are formed as a one-piece component attached to the tool housing 202. In the illustrated example of FIG. 8, a slot is created by the first travel stop 802, the second travel stop 804, and at least the first the rail 510 in which the fastener 702 is insertable.

Figure 9A:
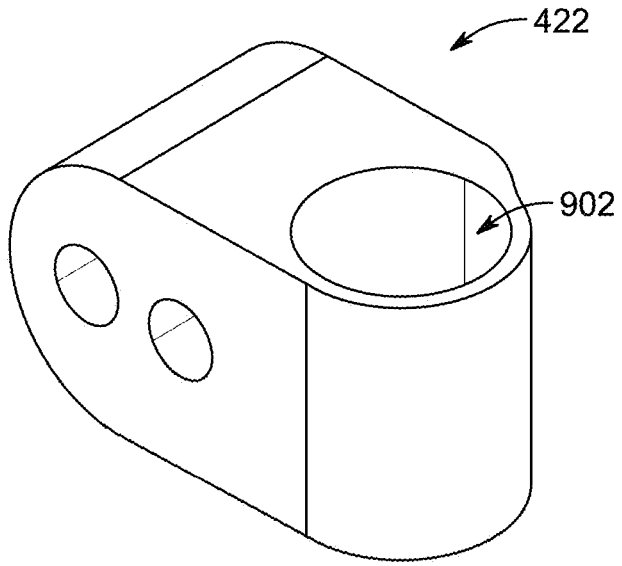
FIG. 9A is a perspective view of an actuable component of an actuator, according to certain embodiments.
Figure 9B:
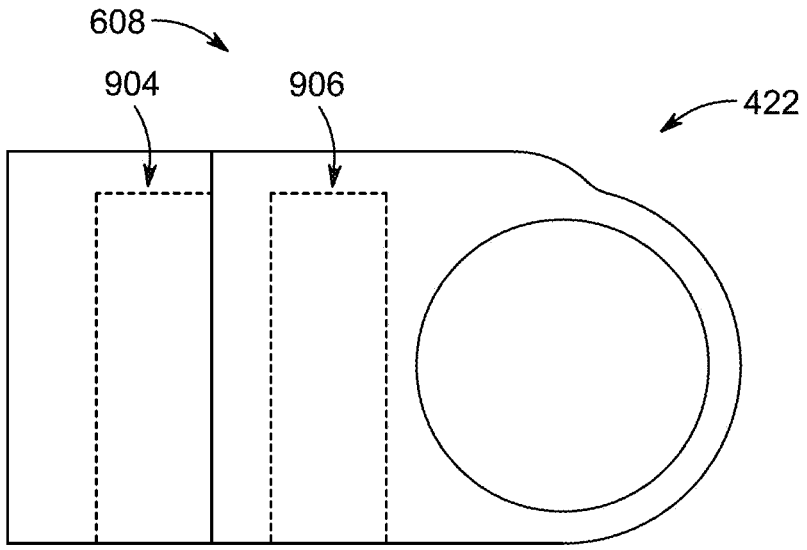
FIG. 9B is a side view of the actuable component showing internal features, according to certain embodiments.

Referring to FIG. 9A and FIG. 9B in combination, illustrated are a perspective view and a side view of the actuable component 422 of the actuator 308 showing internal features, according to certain embodiments. The actuable component 422 includes a cylindrically-shaped aperture 902 positioned on a component body that is configured to receive and house the rotatable component 412 or at least part thereof. The component body of the actuable component 422 forms and/or defines the aperture 902, where the aperture 902 extends entirely through the component body. The cylindrically-shaped aperture 902 and associated machined surface features ensure proper fit and establish a secure mechanical interface that prevents undesired displacement while permitting controlled rotational movement. In some examples, the cylindrically-shaped aperture 902 may include a smooth bearing surface to minimize friction and wear during repeated operational cycles. Additionally or alternatively, in examples where the actuator 308 is a ball screw linear actuator, the actuable component 422 includes one or more raceways, grooves, and/or thread features disposed on an inner surface defining the aperture 902, which are configured to slidably engage ball members interposed between the rotatable component 412 and the actuable component 422 to drive linear motion of the actuator 308. Such surface features may be arranged along the inner surface of the actuable component 422 in a helical or spiral manner with respect to an axis of the aperture 902, parameters of which (e.g., a pitch, a number of turns, a distance between the turns, etc.) effect output requirements of the motor 306 and can be suitably selected to optimize actuator performance.

Further, in some examples, the actuable component 422 of FIG. 9 B is provided with at least two alignment holes thereon for interacting with the spring support member 302, two of which are shown in this example (i.e., the pair of alignment holes 608). In the illustrated examples of FIG. 9B, the pair of alignment holes 608 includes a first hole 904 and a second hole 906 disposed on the component body of the actuable component 422, each of which extends at least partially through the component body of the actuable component 422. That is, the component body of the actuable component 422 forms and/or defines the first hole 904, the second hole 906, and/or any other hole that may be provided with the actuable component 422. The actuable component 422 may be constructed of one or more materials having material characteristics (e.g., sufficient strength, durability, corrosion resistance, etc.) desired for such wireline logging operations such as, for example, a metal, a plastic, and the like, or a combination thereof.

Figure 10:
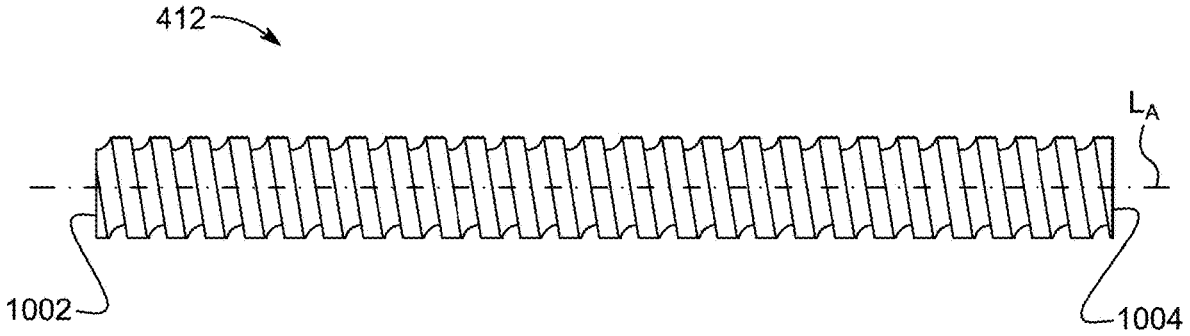
FIG. 10 is a side view of a rotatable component of the actuator, according to certain embodiments.

Referring to FIG. 10, illustrated is a side view of the rotatable component 412 of the actuator 308, according to certain embodiments. The rotatable component 412 of FIG. 10 is cylindrical in shape and/or otherwise includes a cylindrically-shaped body defining a first end 1002 of the rotatable component 412 configured to connect to the support member 416 and a second end 1004 of the rotatable component 412, opposite to the first end 1002, configured to connect to the motor 306 or the output portion 410 thereof. As such, the second end 1004 of FIG. 10 is configured to receive the motor output from the motor 306, thereby rotating the rotatable component 412 about the associated rotation axis together with the motor output portion 410. In some examples, the rotatable component 412 includes a helical thread arranged along an exterior surface of the cylindrically-shaped body, which slidably engages the ball members of the actuator 308 to drive the linear motion of the actuator 308. The rotatable component 412 provides structural integrity and rotational stability during operational cycles and may be constructed of one or more materials having material characteristics (e.g., sufficient strength, durability, corrosion resistance, etc.) desired for such wireline logging operations such as, for example, a metal, a plastic, and the like, or a combination thereof. In some examples, the helical thread extends along a longitudinal axis 'LA' of the rotatable component 412 and creates a continuous spiral groove pattern in the exterior surface of the cylindrically-shaped body that facilitates precise linear motion conversion when rotating in tandem with corresponding threaded elements of the actuable component 422.

Figure 11:
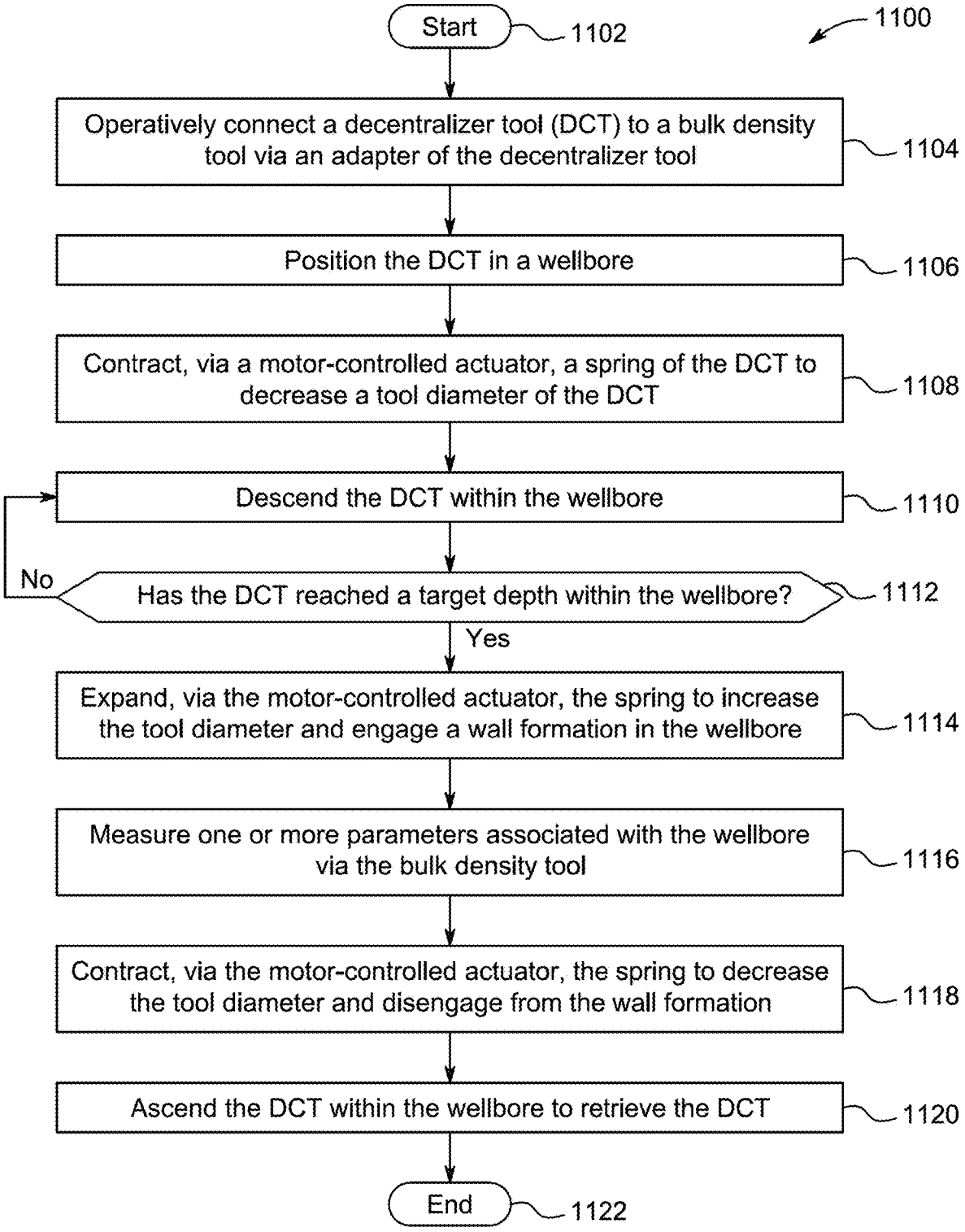
FIG. 11 is a flowchart showing a method of operation of the decentralizer tool, according to certain embodiments.

Referring to FIG. 11, illustrated is a flow chart showing a method 1100 of operation of the decentralizer tool 104, according to certain embodiments. At step 1102, the method 1100 initiates. At step 1104, the method 1100 includes operatively connecting the decentralizer tool (DCT) 104 to the bulk density tool 102 via the adapter 206. In some examples, the decentralizer tool 104 is mechanically connected to the bulk density tool 102 via the adapter 206. In one example, the adapter 206 is inserted in a receptacle of the bulk density tool 102, and the DCT 104 is rotated about the tool axis 204 relative to the bulk density tool 102 to drive engagement of related threads until the DCT 104 is sufficiently secured to bulk density tool 102. In another example, in response to the adapter 206 passing into the receptacle of the bulk density tool 102, an associated lock mechanism temporarily locks to maintain a position and/or orientation of the DCT 104 relative to the bulk density tool 102. In general, the adapter 206 facilitates secure attachment and proper alignment of the decentralizer tool 104 to the bulk density tool 102. In some examples, at step 1104, the adapter 206 creates an operational or functional connection between the DCT 104, the bulk density tool 102, and/or the controller 108, where the controller 108 can communicate with and/or control at least the DCT 104 (e.g., via a wireline cable associated with the bulk density tool 102).

At step 1106, the method 1100 includes positioning the decentralizer tool 104 in the wellbore 106. In some examples, the tool housing 202 enters the wellbore 106 and/or is positioned at a predetermined depth location, for example, via the lifting equipment of the system 100. The decentralizer tool 104 is strategically placed within the wellbore 106 as per measurement conditions and at a proper standoff distance from the wellbore 106 for accurate data acquisition.

At step 1108, the method 1100 includes contracting, via the actuator 308 controlled by the motor 306, the spring 210 of the decentralizer tool 104 to decrease the outer diameter 212 of the decentralizer tool 104. In some examples, the controller 108 controls the motor 306 to generate torque for providing rotational motion that drives the actuator 308 to compress the spring 210 to reduce the radial extension of the decentralizer tool 104. The controlled contraction enables the decentralizer tool 104 to achieve a reduced tool diameter for navigation through restricted sections of the wellbore 106, allow precise diameter adjustment based on downhole conditions and operational requirements.

At step 1110, the method 1100 includes descending the decentralizer tool 104 within the wellbore 106. The method 1100 involves controlled descent of the decentralizer tool 104 through the wellbore 106 using conveyance methods, including a wireline or coiled tubing. During descent, the decentralizer tool 104 maintains its contracted state to minimize resistance and prevent contact with the wellbore 106.

At step 1112, the method 1100 includes checking if the decentralizer tool 104 reached a target depth within the wellbore 106. The depth is measured using techniques such as depth counters to precisely determine the current position of the decentralizer tool 104 relative to the target depth. If the target depth has not been achieved, the decentralizer tool 104 is further lowered to reach the target depth. The target depth may be predetermined based on geological formations, measurement requirements, or specific operational objectives within the wellbore 106.

At step 1114, the method 1100 includes expanding, via the actuator 308 controlled by the motor 306, the spring 210 to increase the outer diameter 212 of the decentralizer tool 104 and engage with the inner wall structure 314 in the wellbore 106. In some examples, the controller 108 controls the motor 306 to drive the actuator 308 to extend or expand the spring 210, causing radial expansion of the decentralizer tool 104 to the diameter 212 in the wellbore 106. In such examples, the intermediate spring section 220 is urged to engage the formation 314 within the wellbore 106, which improves measurement accuracy of the bulk density tool 102.

At step 1116, the method 1100 includes measuring one or more parameters associated with the wellbore 106 via the bulk density tool 102. The bulk density tool 102 may employ, for example, the gamma ray attenuation to determine formation density or one or more parameters that include photoelectric factor, formation evaluation for reservoir characteristics and geological interpretation. Such measurements may be performed while the intermediate spring section 220 is engaged with the formation 314.

At step 1118, the method 1100 includes contracting, via the actuator 308 controlled by the motor 306, the spring 210 to decrease the outer diameter 212 of the decentralizer tool 104 and disengage from the inner wall structure 314 of the wellbore 106. In some examples, the controller 108 controls the motor 306 to activate the actuator 308 to compress the spring 210, causing the outer diameter 212 of the decentralizer tool 104 to retract radially inward. The contraction reduces the outer diameter 212 to release mechanical engagement with the inner wall structure 314 of the wellbore 106. In such example, the intermediate spring section 220 is urged to disengage from the formation 314 within the wellbore 106, which allows the DCT 104 and the bulk density tool 102 to easily maneuver around the formation 314 and/or any other such formation within the wellbore 106.

At step 1120, the method 1100 includes ascending the decentralizer tool 104 within the wellbore 106 to retrieve the decentralizer tool 104. The ascending involves controlled upward movement of the decentralizer tool 104 through the wellbore 106 using the conveyance system. During the ascent position, the decentralizer tool 104 maintains its contracted configuration to prevent interference with wellbore 106. At step 1122, the method 1100 ends.

Figure 12:
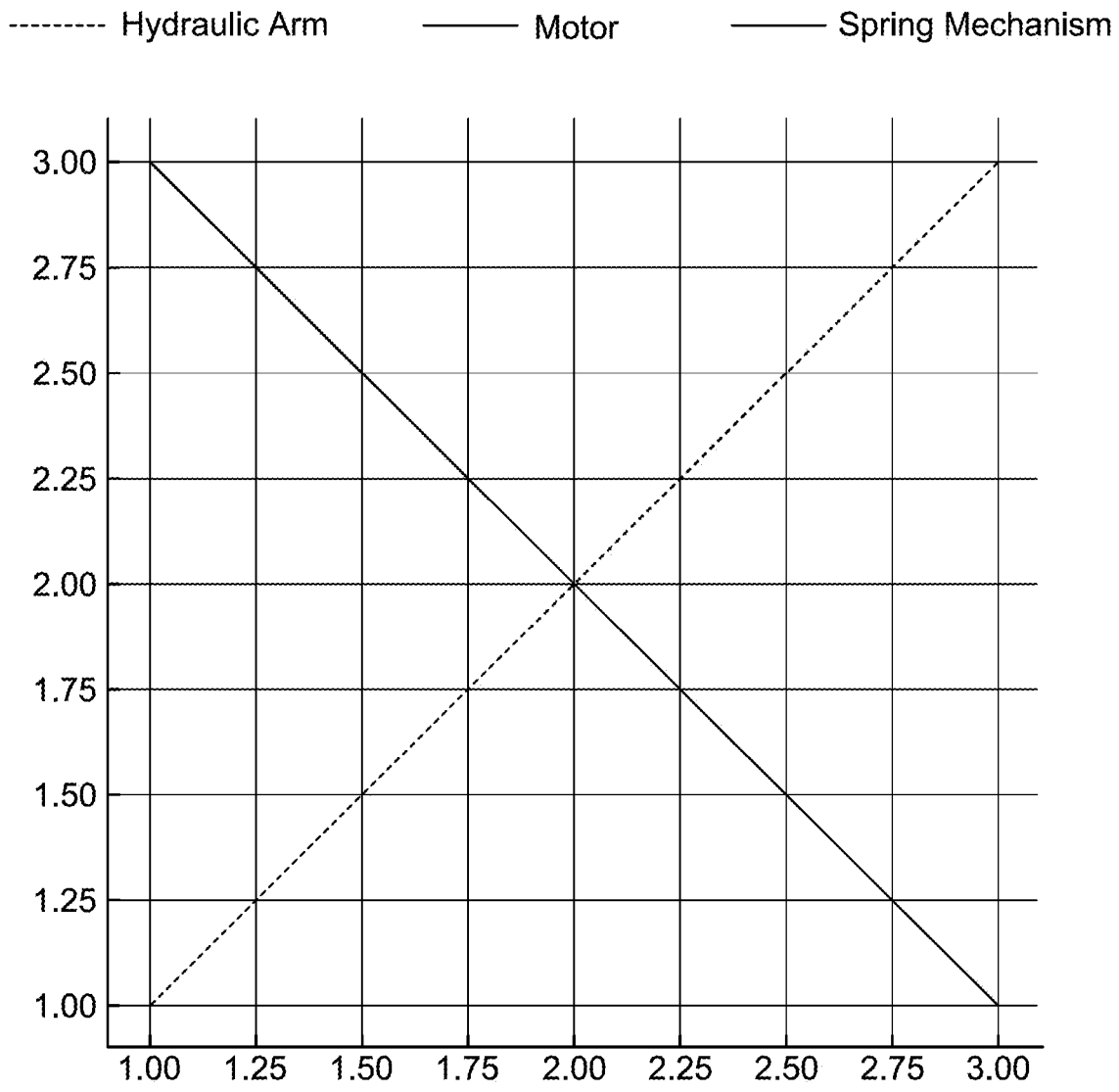
FIG. 12 is a graphical representation showing a performance of the decentralizer tool based on lab set up testing, according to certain embodiments.

Referring to FIG. 13, illustrated is a table showing performance metrics of the decentralizer tool 104, according to certain embodiments. The decentralizer tool 104 demonstrated consistent performance across multiple experimental phases. A graphical representation of the performance of the decentralizer tool 104 is illustrated in FIG. 12. Initial force calibration of the spring 210 resulted in the spring constant of 350 N/m, producing a force of 140 N and a displacement of 0.4 m. The control precision testing of the motor 306 achieved 99% accuracy for precise spring compression operations. Measurement accuracy validation is 95% precision in formation density readings through consistent tool-formation contact. Combined system testing under integrated conditions maintained reliable performance with 135 N spring force, 97.8% motor precision, and 94.8% measurement accuracy, validating the operational effectiveness of the decentralizer tool 104.

It will be appreciated that the decentralizer tool for use with wireline logging operations disclosed in the foregoing description provides numerous advantages. Examples disclosed herein provide a DCT that is connectable to a bulk density tool and has an outer tool diameter that is adjustable. Examples disclosed herein provide a motor-controlled actuator operatively coupled to an external spring of the DCT that adjusts, via the external spring, the outer tool diameter during descent and ascent operations, which facilitates reliably maneuvering the tools within wellbores and/or improves measurement accuracy associated with the bulk density tool. Utilizing the disclosed DCT in connection with bulk density tools results in improved measurement accuracy, reduced operational downtime, and/or enhanced mechanical reliability in complex wellbore environments.

Although certain example systems, apparatus, methods, and articles of manufacture have been disclosed herein, the scope of coverage of this patent is not limited thereto. Obviously, numerous modifications and variations of the present disclosure are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A decentralizer tool for use with wireline logging operations, comprising:

a housing sized to enter a wellbore and defining a longitudinal tool axis of the decentralizer tool, the housing having an inner diameter and an outer diameter;

an adapter at an end of the housing configured to connect to a bulk density tool;

a spring partially defining an outer diameter of the decentralizer tool, the spring including a first spring end coupled to an exterior tool surface of the housing, a second spring end external to the housing that is spaced apart from the first spring end, and an intermediate spring section between the first and second spring ends;

a spring support member extending radially through the housing and including an exposed portion extending radially beyond the outer diameter, the exposed portion coupled to the second spring end and a hidden portion extending radially inwardly of the inner diameter of the housing;

a motor inside the inner diameter of the housing; and an actuator operatively interposed between the spring support member and the motor configured to move, via output of the motor, the spring support member in an axial direction along the longitudinal tool axis between a first target position of the spring support member and a second target position of the spring support member to change a state of the spring, wherein:

the second spring end moves together with the spring support member substantially a same distance as the spring support member;

movement of the spring support member towards the first spring end causes the intermediate spring section to expand toward an inner wall structure of the wellbore to engage the inner wall structure, and movement of the spring support member away from the first spring end causes the intermediate spring section to contract away from the inner wall structure to disengage from the inner wall structure.

2. The decentralizer tool of claim 1, wherein the spring includes a bow spring.

3. The decentralizer tool of claim 1, wherein the housing includes a circumferential wall defining a tool bore in which the motor or the actuator is centrally disposed.

4. The decentralizer tool of claim 3, further including a motor support bracket coupling the motor to an inner surface of the circumferential wall such that a motor output portion of the motor is concentric with the circumferential wall.

5. The decentralizer tool of claim 3, wherein the actuator includes a rotatable component connected to an output portion of the motor that extends linearly away from the motor output portion toward the adapter such that the rotatable component is concentric with the circumferential wall.

6. The decentralizer tool of claim 5, further including an actuator support member protruding from an inner surface of the circumferential wall in a radially inward direction toward the tool axis that is configured to rotatably support an end of the rotatable component of the actuator.

7. The decentralizer tool of claim 1, wherein the housing includes an opening thereon exposing an enclosed cavity defined by the housing, the spring support member extending through the opening from the second spring end to an actuable component of the actuator.

8. The decentralizer tool of claim 7, wherein the opening of the housing includes an elongated slot arranged parallel to the tool axis.

9. The decentralizer tool of claim 7, wherein the hidden portion of the spring support member includes a proximal end of the spring support member disposed in the enclosed cavity that is connected to the actuable component, and wherein the exposed portion of the spring support member includes a distal end of the spring support member external to the enclosed cavity.

10. The decentralizer tool of claim 9, wherein the spring support member is tapered such that a thickness of the proximal end is greater than a thickness of the distal end.

11. The decentralizer tool of claim 9, wherein the spring support member includes a pair of alignment pegs protruding from the proximal end that is inserted in a respective pair of alignment holes on the actuable component to maintain an orientation of the spring support member relative to the actuable component during tool diameter adjustments.

12. The decentralizer tool of claim 9, further including a fastener coupling the second spring end to the spring support member that is inserted in a hole on the distal end of the spring support member.

13. The decentralizer tool of claim 12, further including a guide member coupled to the housing including a rail external to the housing that extends linearly across the exterior tool surface to at least partially define a travel path of the spring support member, the rail configured to slidably engage the fastener to guide movement of the spring support member along the travel path between the first and second target positions of the spring support member.

14. The decentralizer tool of claim 13, wherein the guide member includes:

a first travel stop coupling a first rail end of the rail to the housing that corresponds to the first target position of the spring support member, and a second travel stop, spaced apart from the first travel stop, coupling a second rail end of the rail to the housing that corresponds to the second target position of the spring support member.

15. The decentralizer tool of claim 1, wherein the actuator is a ball screw linear actuator.

16. The decentralizer tool of claim 15, wherein the ball screw linear actuator includes a screw shaft connected to the motor that is arranged in the housing parallel relative to the tool axis.

17. The decentralizer tool of claim 16, wherein an axis of the screw shaft is aligned to the tool axis.

18. The decentralizer tool of claim 16, wherein the housing includes a cylindrically-shaped body concentric with the screw shaft.

19. The decentralizer tool of claim 16, wherein the ball screw linear actuator includes a ball nut operatively coupled the screw shaft that is coupled to the hidden portion of the spring support member, the ball nut configured to move between opposing ends of the screw shaft when the screw shaft rotates about an axis thereof.

* * * * *